United States Patent [19]

Asaoka

[11] 4,038,112

[45] July 26, 1977

[54] WELL-FRACTURING EXPLOSIVE COMPOSITION

[75] Inventor: Leo K. Asaoka, Port Tobacco, Md.

[73] Assignee: Talley-Frac Corporation, Mesa, Ariz.

[21] Appl. No.: 576,644

[22] Filed: May 12, 1975

[51] Int. Cl.[2] ..... C06B 45/00; C06B 33/08; C06B 25/36

[52] U.S. Cl. ..... 149/2; 149/38; 149/89; 149/110

[58] Field of Search ..... 149/2, 89, 91, 92, 38, 149/110, 111, 112

[56] References Cited

U.S. PATENT DOCUMENTS

| | | | |
|---|---|---|---|
| 3,318,741 | 5/1967 | Jones | 149/89 |
| 3,338,165 | 8/1967 | Minnick | 102/27 R |
| 3,456,589 | 7/1969 | Thomison | 149/2 |
| 3,546,034 | 12/1970 | Francis | 149/2 |
| 3,663,324 | 5/1972 | Roberts | 149/91 |
| 3,713,915 | 1/1973 | Fast | 149/2 |
| 3,765,967 | 10/1973 | Funk | 149/38 |
| 3,797,392 | 3/1974 | Eckels | 149/2 |

*Primary Examiner*—Verlin R. Pendegrass
*Assistant Examiner*—Donald P. Walsh
*Attorney, Agent, or Firm*—Pennie & Edmonds

[57] ABSTRACT

A nitrate or nitroparaffin-base liquid exlosive composition having a small critical diameter yet which is essentially free of particulate metals such as may render such compositions unduly brisant or susceptible to decomposition, and which is consistent with the safety requirements of geological fracturing, including an inert solid ballistic modifier having a sonic velocity substantially different from that of the explosive material in the composition and an average particle size of less than 10 microns, forming from about 5% to 20% by weight of the composition.

6 Claims, No Drawings

WELL-FRACTURING EXPLOSIVE COMPOSITION

BACKGROUND OF THE INVENTION

1. Field of the Invention

This invention relates to a liquid explosive which is particularly suitable for fracturing a geological formation adjacent a well bore, for bringing in the well or for increasing the productivity of a well which has substantially ceased to produce oil, water or gas. It is also suitable for other applications, such as quarrying, especially where an explosive composition is required which will conform to the formation in which it is placed and will permit propagation of the explosion through the fine fissures often encountered in geological fracturing.

To bring in a well, after it has been drilled, it is usually necessary to increase the permeability of the producing formation to stimulate flow in the well. This was commonly done by "shooting" the well with a nitroglycerin charge, acidizing (in certain types of formation) or hydraulic fracturing. When a formerly productive well has ceased to produce, the pay zone is similarly fractured to reactivate the well. The purpose of fracturing is to increase the permeability of the productive formation or pay zone, permitting flow from the producing formation into and up the well bore.

Explosive fracturing was originally carried out by placing a nitroglycerin charge in the well bore and detonating it. Such charge could be desensitized nitroglycerin in liquid or gel form or a mixture of pure nitroglycerin and ethylene glycol dinitrate (EGDN). The disadvantages of nitroglycerin, used for many years for this purpose, are many. For example, it is extremely shock sensitive and difficult to handle and transport. All nitroglycerins are too sensitive, for example, to be pumped or poured into a well and must be carefully placed there, either in gel form or as desensitized liquid. Liquid and slurry explosives other than nitroglycerin have been tried but, in general, have not been successful for reasons including instability, segregation of constituents, detonation problems and vulnerability to leaching and dilution by fluids in well bores.

"Bore shots", as fracturing operations are called when the explosive is placed wholly within the well bore, tend to destroy the bore, and while they do result in exposing more of the surface of the formation to the bore, they do not materially increase the permeability of the formation itself. It has been found that the fracturing of a large volume of the formation, for optimum increase in permeability, requires an explosive having a small critical diameter which can be loaded back into the formation itself, permitting it to propagate an explosion through the narrow fissures and crevices of the formation. The term "narrow fissures" or "fine fissures" as used herein means those narrow cracks or openings found in geological strata adjacent well bores, commonly formed by hydraulic fracturing and having widths from approximately one-quarter inch down to a fraction of a millimeter. Nitroglycerin, for example, has been shown to propagate an explosion in fissures as narrow as 1/32 inch, according to Eakin and Miller, "Explosives Research to Improve Flow Through Low Permeability Rock", Paper No. SPE 1715 (Third SPE of AIME Drilling and Rock Mechanics Conference, 1967). Other methods limit effective propagation of the explosion to a relatively small radius around the well bore bottom.

2. History of the Prior Art

To overcome these drawbacks, experiments have been conducted for several decades with liquid explosives other than nitroglycerin, including slurry explosives, which are dispersions of solid explosives or of one or more explosive constituents suspended in water, oil, or some other medium. Liquid (including slurry) explosives have the advantage of being able to conform to, and thus more readily fill, the well bore, resulting in greater explosive power. It is important that explosives of this kind be capable of being pressured back into the geological formation adjacent the well bore in order to obtain complete, even, and adequate fracturing of the formation and to minimize damage to the well bore and to any casing installed in the well.

A serious problem in liquid and slurry explosives developed to date has been their inability to undergo pressurization into a well formation, and still be capable of consistent and reliable detonation without the necessity of using complex and expensive detonating systems. In certain instances, indispensible constituents of the explosive are filtered out in passing through the narrow fissures and pores of the formation. In other cases, exposure to fluids in the well bore or formation may cause dilution of the explosive, rendering it incapable of detonation, or may leach out certain of its essential constituents.

Other explosive compositions are highly diameter sensitive, meaning that they are incapable of being detonated in cross-sections of less than a certain diameter. Diameter sensitivity is a measure of the capability of an explosive compound to propagate an explosion in narrow passages, such as geological fissures. Diameter sensitivity as used herein has reference to the ability of a composition to propagate an explosion along a tube filled with the composition, containing a restricted orifice of a given diameter, so that the explosion propagates past the orifice and is not extinguished by the reduced diameter of the composition. Thus, an explosive with a diameter sensitivity (or critical diameter) of 1 inch, placed in a tube of greater diameter, will propagate an explosion past a 1 inch diameter orifice, but is incapable of propagating an explosion past an orifice of lesser diameter. This indicates that the same explosive will propagate an explosion in a 1 inch diameter geological fissure.

Explosive compositions are known having very low critical diameters; for example, nitroparaffin-base compositions disclosed in U.S. Pat. No. 3,663,324 have critical diameters of the order of 1/64 inch. However, those compositions contain finely divided aluminum, which may react with certain acids found in some geological environments and, in addition, produces too brisant an explosive for some applications. A highly brisant explosive tends to rubblize the formation rather than simply fracturing it, creating large amounts of debris which clog the formation and impede the flow of oil or gas from it.

Generally, in an explosive, the desirable property of lower critical diameter goes hand in hand with the undesirable property, for formation fracturing, of higher brisance. A concomitant drawback of explosives with low critical diameters is ofttimes a higher impact sensitivity than is compatible with the very stringent safety requirements of explosive fracturing.

It is known that the addition to an explosive of materials of a different sonic velocity from that of the explosive medium causes the shock wave of the explosion to generate heat at the boundary of the additive, tending to reinforce and sustain or enhance propagation of the explosion. The added material may be a liquid, gaseous or solid phase. See, for example, U.S. Pat. No. 3,456,589, issued July 22, 1969, to Dow Chemical Company, which discloses explosives containing air-filled glass microspheres as a sensitizing agent. However, the effects of such sensitization on critical diameter, brisance and impact sensitivity are difficult to predict and are often incompatible with the requirements of formation fracturing.

SUMMARY OF THE INVENTION

This invention is based on the discovery tht the properties of certain classes of generally known geological fracturing explosives may be substantially improved by the addition of from about 5% to 20% (weight percent, relative to the total weight of the explosive) inert particulate solids having a sonic velocity substantially different from that of the liquid explosive itself. In particular, the addition of such solids in accordance with the invention results in a very low critical diameter but does not increase brisance to unacceptably high levels. Impact sensitivity and stability fo the explosive are also maintained compatible with safety requirements applicable to formation fracturing.

DETAILED DESCRIPTION OF PREFERRED EMBODIMENTS

Explosives within the scope of this invention include the nitroparaffin and nitrate-based compositions known in the field of explosive fracturing, for example, the lower nitroalkanes, i.e., nitromethane, nitroethane and nitropropane, and nitrate compositions such as diethylene glycoldinitrate and nitroisobutyltrinitrate.

Additionally, the explosive composition preferably includes an explosive thickening agent and one or more explosive additives as well as thickeners, acid scavengers and other processing aids generally employed in such explosives and which may be appropriate to the particular explosive and application involved.

As an explosive thickening agent, blasting gelatins may be employed. They vary somewhat in composition, and may, for example, comprise about 50% nitromethane, 45% 70/30 ethylene glycol dinitrate/nitroglycerine, about 3½% nitrocellulose and abpout ½% chalk. Various other blasting gel compositions without nitromethane are commercially available and may be used if compatible with the other constituents of the specific explosive composition employed.

Highly explosive additives may be employed to enhance the explosive power of the composition and render it detonable by a No. 8 blasting cap. With a nitromethane-base explosive, it is preferable to use one of the nitramine explosives such as RDX (cyclotrimethylenetrinitramine) or HMX (cyclotetramethylenetetranitramine). TNT or other solid or liquid high explosive materials may be used which are of a shock sensitivity comparable to RDX and HMX so that the resultant composition is readily detonable by a No. 8 blasting cap.

Various other processing aids conventionally found in liquid explosives and which are compatible with the constituents of the particular explosive and appropriate to its intended application may also be employed. For example, conventional thixotropic thickening agents are preferably employed to maintain an even dispersion of the composition during storage periods and loading into the formation. One such agent, for example, is fine colloidal pyrolytic silica with a particle size of about .02 microns such as that manufactured by the Cabot Corporation under the trademark Cab-O-Sil. Another such material is Gantrez AN-119 a copolymer of methyl vinyl ether and maleic anhydride marketed by General Aniline and Film Corporation. An acid scavenger is also preferably used for tying up any nitrogen dioxide that may be formed by decomposition of any of the various nitro or nitrate constituents of the explosive. Exemplary of such acid scavengers are resorcinol, 2-nitrodiphenolamine (2NDPA) and ethylcentrolite.

In accordance with the invention, there is added to an explosive composition as described broadly above from about 5 to about 20 weight percent of an inert ballistic modifier having a sonic velocity substantially different from the liquid explosive alone, in the form of a finely divided particulate solid. The precise difference between the sonic velocity of the liquid constituents of the explosive and that of the ballistic modifier is not critical for purposes of the invention and suitable materials in accordance with that criterion are illustrated herein. It is believed, nevertheless, that the mechanism involved in producing the superior properties of compositions in accordance with the invention is the formation of "hot spots" as the explosive shock wave propagates past the surfaces of the ballistic modifier, due to the abrupt difference in the sonic velocity of the medium; the resultant heat may sustain propagation of the explosion in diameters where, absent the modifier, it would be incapable of propagating. Unlike an active (as opposed to an inert) ballistic modifier, however, it does not adversely affect the stability and shock sensitivity of the explosive, and, unlike liquid and gasoline ballistic modifiers, inert solids have been found to be capable of achieving the low critical diameters desirable for geological fracturing.

In accordance with the invention, the inert ballistic modifier is preferably of an average particle size of a few microns. Generally, there is a correlation between smaller particle size and lower critcal diameter for the explosive. However, too small a particle size results in an increase in viscocity, rendering the composition difficult to process and use, as is explained more fully below. A preferred ballistic modifier is Silcosil-395, commercially available from the Ottawa Silica Company, a fine sand having an average particle size of three microns and a particle size range of approximately 1–10 microns. Most preferably, between about 5 and 16 weight percent of the Silcosil or other ballistic modifier may be employed preferably with an average particle size under 5 microns. Increasing the proportion of ballistic modifier within the range stated above does not change the critical diameter very much but generally tends to increase brisance, so that formulations may be selected with the desired critical diameter and varying brisance for each particular application. With less than 5 weight percent of the ballistic modifier, the critical diameter increases appreciably. Other inert ballistic modifiers in accordance with the invention may include various particulate alumina materials as well as crushed rock, marble, glass, dried clay and various metallic oxides. The composition of the particular inert ballistic modifier employed is unimportant as it does not enter into any chemical reaction in the explosive; hence it is claimed as "inert" and "non-reactive". Its density must be chosen to afford a sonic velocity substantially different from that of the explosive, and its particle size should be within the range described above. Considerations of availability, ease of processing and cost also bear on the selection of an appropriate inert ballistic modifier in accordance with the invention.

When fine (about 0.02 micron) colloidal pyrolytic silica is employed as a thickening agent, as described above, it also acts as a ballistic modifier in accordance with the present invention. However, such thickening agent cannot constitute all of the ballistic modifier required in practicing the invention, because even at a level of about 4% of such thickener by weight, the composition would become too viscous to process and use. Hence the proportion of such colloidal thickening agents is limited for practical purposes to about 2%, requiring an additional 3% of ballistic modifier with a particle size large enough so that it does not appreciably thicken the composition, i.e. about 1 micron or greater. These percentages may vary slightly depending upon the processes used to formulate the composition and the environment of its intended use, particularly the maximum viscosity that may be acceptable. As used herein and particularly in the claims hereof, a constituent may thus be both a thickening agent and a ballistic modifier, and the weight percent limitations for both such constituents are applicable to it.

Inasmuch as the present invention is applicable to a wide range of nitroparaffin and nitrate-based explosive compositions generally employed in connection with fracturing and related geological operations, the particular constituents employed and their proportions will vary with the specific liquid explosive used and its intended application. The compositions generally of such explosives are familiar to those skilled in this art. Broadly, for example, for a nitromethane-base explosive, the composition may comprise about 40% to 75% nitroparaffin, such as nitromethane, from about 5% to 30% blasting gelatin, about 4% to 12% high explosive additive, from about 5% to 20% and preferably from about 5% to 16% inert ballistic modifier, and from about 1% to 8% stabilizers, thickeners and other processing aids.

A particularly preferred specific embodiment of the invention has the following composition:

EXAMPLE

| COMPONENT | WEIGHT PERCENT |
|---|---|
| Nitromethane | 58.5 |
| Blasting Gelatin | 20.0 |
| 50.0% Nitromethane | |
| 45.4% 70/30 EGDN-Nitroglycerin | |
| 3.85% Nitrocellulose | |
| 0.65% Chalk | |
| Silicon Dioxide (3 micron average particle size) | 10.0 |
| Cyclotrimethylenetrinitramine (RDX) | 7.0 |
| Cab-O-Sil | 2.0 |
| Resorcinol | 2.0 |
| Gantrez AN-119 | 0.5 |
| | 100% |

The foregoing composition as well as explosives generally in accordance with the invention may be formulated in the conventional manner by mixing the various constituents, preferably with the inert ballistic modifier added at or towards the end of the formulation, after addition of the thickening agents. Care should be taken in accordance with generally accepted practice in this area to limit the viscosity of the explosive at the temperature of intended use so that it can be pressurized through the crevices generally found in underground formations at available well-head pumping pressure. Yet the composition must be viscous enough so that it maintains an even dispersion during storage and loading. The critical diameter of the composition of the specific example given above is about 0.013 inches, better than 1/64 inch, and its brisance is appeciably lower than that of comparable explosives employing, for example, powdered metals to enhance critical diameter. With respect to the inert ballistic modifier, note that it must be a solid in accordance with the invention and not a liquid or a gas. In this context, the glass air-filled microspheres referred to in U.S. Pat. No. 3,456,589, mentioned above, behave effectively as a gas, the ballistic modifier is defined in the claims as having substantially homogeneous particles in order to exclude such microspheres.

It will be apparent to those skilled in the art that various modifications of the invention as described above may be made without departing from its spirit and scope as defined in the appended claims.

What is claimed is:

1. In a liquid explosive composition for geological fracturing having a nitroparaffin or nitrate base, the improvement comprising between 5 and 20 weight percent of a ballistic modifier in the form of finely divided inert non-reactive solids, the particles of which are substantially homogeneous, having a sonic velocity substantially different from that of the remainder of the composition and having a particle size less than about 10 microns.

2. A liquid explosive composition as defined in claim 1 wherein the concentration of the ballistic modifier is sufficient to render the critical diameter of the composition less than about 1/64 inch.

3. A liquid explosive composition as defined in claim 1 wherein the ballistic modifier is a solid selected from the group consisting of sand, alumina, crushed rock, marble, glass, clay and metal oxides, having an average particle size less than about 5 microns.

4. A liquid explosive composition suitable for geological fracturing comprising essentially by weight percent about 40–75% nitroparaffin, about 5–30% blasting gelatin, about 5–20% inert non-reactive solid ballistic modifier, the particles of which are substantially homogeneous, with an average particle size less than 10 microns and having a sonic velocity substantially different from that of the remainder of the composition, and about 1–8% stabilizers and processing aids including thickening agents sufficient to maintain the homogeneity of the composition.

5. A liquid explosive as defined in claim 4 comprising essentially 58% nitromethane, 20% blasting gelatin, 10% silicon dioxide with an average particle size of about 3 microns, 7% cyclotrimethylenetrinitramine, and 5% stabilizers and processing aids, including sufficient thickening agents to maintain the homogeneity of the composition.

6. A method of reducing the critical diameter of a nitroparaffin or nitrate-based liquid explosive composition suitable for geological fracturing without unduly increasing its brisance, comprising adding thereto between about 5 and 20 weight percent of a solid inert non-reactive ballistic modifier, the particles of which are substantially homogeneous, having an average particle size less than about 10 microns and a sonic velocity substantially different from that of the remainder of such composition.

* * * * *

UNITED STATES PATENT AND TRADEMARK OFFICE

CERTIFICATE OF CORRECTION

PATENT NO. : 4,038,112

DATED : July 26, 1977

INVENTOR(S) : Leo K. Asaoka

It is certified that error appears in the above-identified patent and that said Letters Patent are hereby corrected as shown below:

Abstract, line 1, "exlosive" should read --explosive--.

Column 3, line 17, "tht the" should read --that the--.

Column 3, line 27, "fo" should read --of--.

Column 3, line 49, "abpout" should read --about--.

Column 3, line 55, "and render" should read --and to render--.

Column 4, line 36, "gasoline ballistic" should read --gaseous ballistic--.

Column 4, line 45, "viscocity" should read --viscosity--.

Column 5, line 63, "or towards the" should read --or toward the--.

Column 6, line 6, "appeciably" should read --appreciably--.

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*